United States Patent [19]

Fujimura et al.

[11] Patent Number: 4,777,924

[45] Date of Patent: Oct. 18, 1988

[54] FUEL SUPPLY CONTROL METHOD FOR INTERNAL COMBUSTION ENGINES AFTER STARTING

[75] Inventors: Akira Fujimura; Yoshio Wazaki, both of Wako, Japan

[73] Assignee: Honda Giken Kogyo Kabushiki Kaisha, Tokyo, Japan

[21] Appl. No.: 120,073

[22] Filed: Nov. 13, 1987

[30] Foreign Application Priority Data

Dec. 29, 1986 [JP] Japan ..... 61-315783

[51] Int. Cl.[4] ..... F02D 41/14

[52] U.S. Cl. ..... 123/489; 123/491

[58] Field of Search ..... 123/440, 489, 491, 179 G, 123/179 L

[56] References Cited

U.S. PATENT DOCUMENTS 4,399,792 8/1983 Otsuka et al. ..... 123/489

4,505,246 3/1985 Nakajima et al. ..... 123/489

FOREIGN PATENT DOCUMENTS 57-70932 5/1982 Japan .

61-234237 10/1986 Japan .

*Primary Examiner*—Andrew M. Dolinar

*Attorney, Agent, or Firm*—Lyon & Lyon

[57] ABSTRACT

After starting of an internal combustion engine, a quantity of fuel to be supplied to the engine is increased by the use of a fuel increment, and at the same time a period of time is counted which elapses from the time an oxygen concentration sensor has its internal resistance decreased below a predetermined value. When the period of time counted exceeds a predetermined period of time, the increase of the quantity of fuel is terminated and simultaneously calculation of a correction value responsive to oxygen concentration in exhaust gases sensed by the sensor is started, and the quantity of fuel is corrected by means of the correction value calculated. A temperature in the engine intake system is sensed, and the above predetermined period of time is to a larger value as the sensed intake system temperature is higher.

6 Claims, 6 Drawing Sheets

FUEL SUPPLY CONTROL METHOD FOR INTERNAL COMBUSTION ENGINES AFTER STARTING

BACKGROUND OF THE INVENTION

This invention relates to a fuel supply control method for internal combustion engines after starting, and more particularly to a method of this kind which is intended to set a proper fuel increment applied to a fuel quantity supplied to an internal combustion engine immediately after being restarted in a hot state.

Conventionally, a fuel supply control method for internal combustion engines has generally been employed, which obtains a signal for commanding initiation of air-fuel ratio feedback control based upon an output from an oxygen concentration sensor provided in an exhaust system of the engine, and upon obtainment of the signal, initiates the feedback control of the air-fuel ratio, e.g. the fuel quantity injected by fuel injection valves provided in an intake system of the engine. It has also generally been employed to increase the fuel injection quantity in response to the temperature of an internal combustion engine after starting of the engine and until the air-fuel ratio feedback control is initiated. Amongst these conventional methods, a first method has been proposed by the assignee of the present application by Japanese Provisional Patent Publication (Kokai) No. 61-234237, in which a predetermined lower limit value is provided for the initial value of a fuel increment applied to the fuel injection quantity after starting of an internal combusiton engine in order to secure a certain amount of fuel increase in the fuel injection quantity when the engine is restarted in a hot state. Further, a second method has been proposed also by the assignee of the present application by Japanese Provisional Patent Publication (Kokai) No. 57-70932, in which a time period is counted after starting of an internal combustion engine and until the temperature of the engine reaches a predetermined value, a determination is made as to whether a predetermined time period has elapsed from the time the internal resistance of an oxygen concentration sensor decreased to a predetermined value corresponding to completion of activation of the oxygen concentration sensor, and upon counting up the two kinds of time periods, a signal is obtained for commanding initiation of the air-fuel ratio feedback control.

However, when an internal combustion engine is restarted in a hot state, such as in the event that the engine is once stopped after running at high speeds and started soon again, it often happens that due to high temperature prevailing inside the fuel supply system of the engine, e.g. fuel injection valves gas bubbles are formed in the fuel supply system. This causes a substantial decrease in the fuel quantity supplied to the engine so that the air-fuel mixture supplied to the engine is in effect leaned, which spoils the startability of the engine. This disadvantage cannot be fully overcome by the above-mentioned first method wherein the lower limit value is provided for the initial value of the fuel increment, because a specially large value of the fuel increment has to be set and stored beforehands so as to be applied at restarting of the engine in a hot state, which, however, cannot achieve the air-fuel ratio control in a precise manner. The second method, referred to above, wherein a feedback control initiating signal is obtained upon the lapse of a predetermined time period after completion of the oxygen concentration sensor, cannot fully overcome the above disadvantage, because if after restarting of the hot engine the air-fuel ratio feedback control is initiated immediately upon the lapse of the predetermined time period, which is set at a fixed value irrespective of the engine temperature, gas bubbles contained in the fuel cannot be completely removed, still involving a problem of uncertain air-fuel ratio of the air-fuel mixture supplied to the engine and hence uncertain startability of the engine.

SUMMARY OF THE INVENTION

It is the object of the invention to provide a fuel supply control method for an internal combustion engine, which prolongs the period of time during which the fuel quantity is increased after starting of the engine, by retarding the timing of generation of the air-fuel ratio feedback control initiating signal when the temperature within the engine intake system is high, thereby enabling to completely remove the gas bubbles contained in the fuel and hence preventing the air-fuel ratio from becoming leaned and securing smooth starting of the engine.

In order to attain the above object, the present invention provides a method of controlling the supply of fuel to an internal combustion engine after starting thereof, including the steps of increasing a quantity of fuel to be supplied to the engine by the use of a fuel increment after the starting of the engine, counting a period of time which elapses from the time a sensor for sensing oxygen concentration in exhaust gases from the engine has internal resistance thereof decreased below a predetermined value after the starting of the engine, terminating the increase of the quantity of fuel to be supplied to the engine and simultaneously starting calculating a value of a correction value in response to the oxygen concentration sensed by the sensor when the period of time counted exceeds a predetermined period of time, and correcting the quantity of fuel to be supplied to the engine by means of the correction value calculated.

The method according to the invention is characterized by the improvement comprising the steps of: (a) sensing a temperature in an intake system of the engine; and (b) increasing the predetermined period of time as the temperature in the intake system sensed is higher.

Preferably, when the temperature in the intake system sensed is lower than a predetermined value, the predetermined period of time is set to a first value, and when the temperature in the intake system sensed is higher than the predetermined value, the predetermined period of time is set to a second value larger than the first value.

Also preferably, when the temperature in the intake system sensed is higher than the predetermined value, the predetermined period of time is set to larger values as the temperature sensed in the intake system becomes higher.

The temperature in the intake system may be the temperature of intake air being supplied to the engine.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
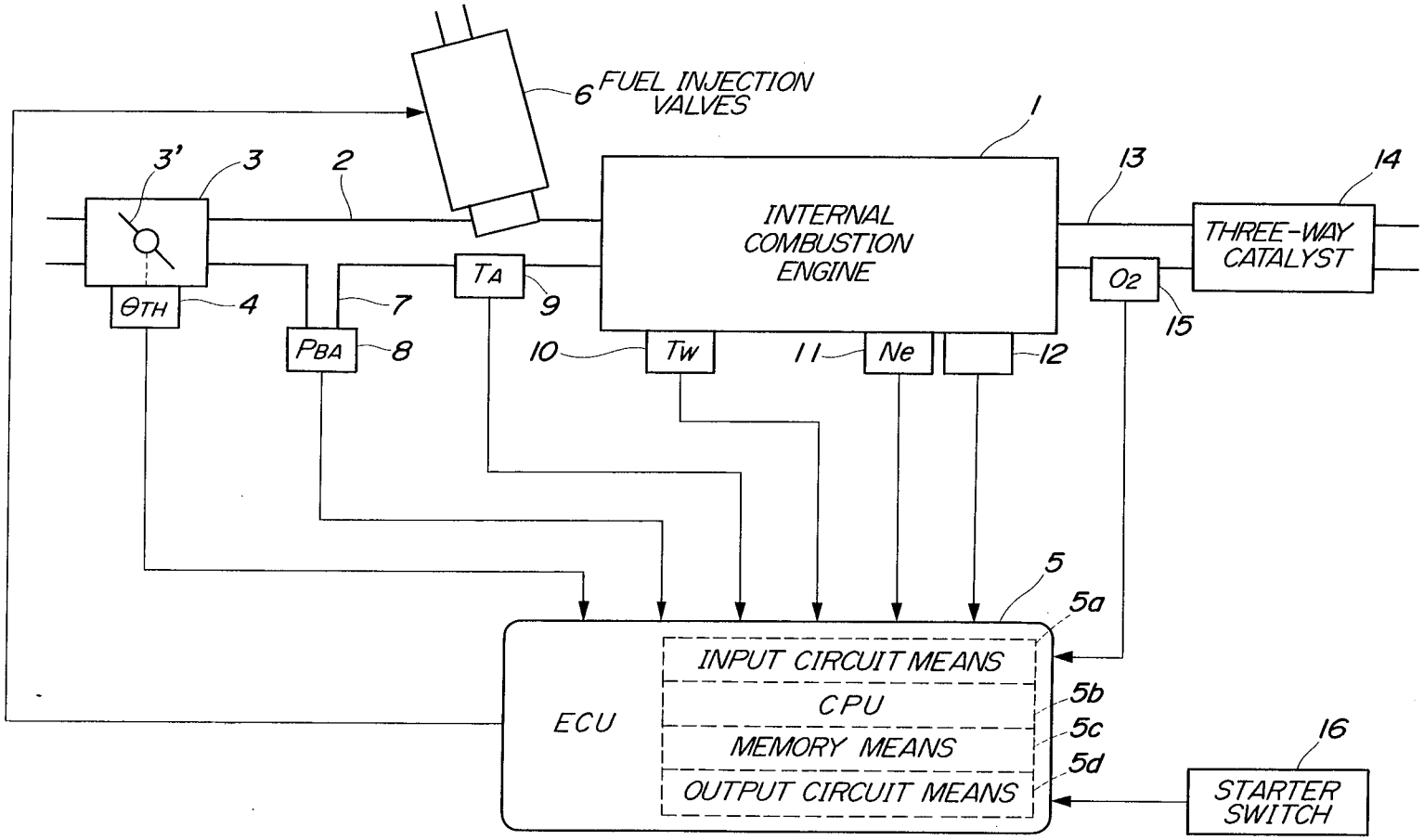
FIG. 1 is a block diagram of the whole arrangement of a fuel supply control system for an internal combustion engine, which executes the method according to the invention.

Referring first to FIG. 1, there is shown the whole arrangement of a fuel supply control system for an internal combustion engine, which executes the method according to the invention. Connected to the engine 1 which may be a four-cylinder type is an intake pipe 2. Arranged at an intermediate portion of the intake pipe 2 is a throttle body 3 in which a throttle valve 3' is mounted. Connected to the throttle valve 3' is a throttle valve opening ($\theta$th) sensor 4 which converts the sensed throttle valve opening into an electric signal and delivering same to an electronic control unit (hereinafter called "the ECU") 5.

Fuel injection valves 6, only one of which is shown, are inserted into the interior of the intake pipe 2 at locations intermediate between the cylinder block of the engine 1 and the throttle body 3 and each arranged slightly upstream of an intake valve, not shown, of a corresponding one of the engine cylinders. The fuel injection valves 6 are connected to a fuel pump, not shown, and electrically connected to the ECU 5 to have their valve opening periods controlled by control signals therefrom.

An intake pipe absolute pressure (PBA) sensor 8 is communicated via a pipe 7 with the interior of the intake pipe 2, for sensing absolute pressure within the intake pipe 2 and supplying an electric signal indicative of the sensed absolute pressure to the ECU 8 to which it is electrically connected.

An intake air temperature (TA) sensor 9 is arranged in the intake pipe 2 at a location downstream of the intake pipe absolute pressure sensor 8, for converting the sensed intake air temperature into an electric signal and sending same to the ECU 5.

The cylinder block of the engine 1 is provided therein with an engine coolant temperature (TW) sensor 10 for sensing the temperature of engine coolant. The sensor 10 is formed of a thermistor, for instance, and is embedded in a peripheral wall of one of the engine cylinders filled with engine coolant, and electrically connected to the ECU 5 for supplying an electric signal indicative of the sensed coolant temperature thereto.

Arranged in facing relation to a camshaft or a crankshaft of the engine 1 are an engine rotational speed (Ne) sensor 11 for sensing the rotational speed of the engine and a cylinder discriminating sensor 12 for sensing the position of a particular one of the engine cylinders, the sensors being electrically connected to the ECU 8 for supplying respective electric signals indicative of the sensed rotational speed and particular cylinder position thereto.

The engine rotational speed sensor 11 is adapted to generate a pulse of a crank angle position signal (hereinafter called "the TDC signal") at each of predetermined crank angles in advance of a top dead center (TDC) corresponding to the start of a suction stroke of each of the cylinders each time the engine crankshaft rotates through 180 degrees in the case of a four cycle-four cylinder engine, and the cylinder discriminating sensor 12 is adapted to generate a pulse of a cylinder discriminating signal at a predetermined crank angle position of the particular engine cylinder, pulses of the TDC signal and the cylinder discriminating signal being supplied to the ECU 5.

Arranged in an exhaust pipe 13 of the engine 1 is a three-way catalyst 14 for purifying HC, CO, and $NO_x$ components contained in exhaust gases emitted from the engine 1. An oxygen concentration sensor ($O_2$ sensor) 15 is inserted into the interior of the exhaust pipe 3 at a location downstream of the three-way catalyst 14 for sensing the concentration of oxygen in the exhaust gases and electrically connected to the ECU 5.

Further connected to the ECU 5 is a starting switch 16 of the engine 1, the position of which indicates the operation of a starting motor, not shown, of the engine 1, so that the ECU 5 is supplied with an electric signal indicative of the on-off state of the starting switch 16.

The ECU 5 comprises input circuit means **5*a* having functions, e.g. of shaping the waveforms of input signals from part of the aforementioned various sensors and the starting switch 16, shifting the levels of output voltages from part of the sensors into a predetermined level, and converting analog signals from part of the sensors into digital signals, a central processing unit (hereianfter called "the CPU") 5*b*, memory means 5*c* storing various control programs executed within the CPU 5*b* and for storing results of various computations also executed within the CPU 5*b*, and output circuit means 5*d* for supplying driving signals to the fuel injection valves 6**.

Figure 2:
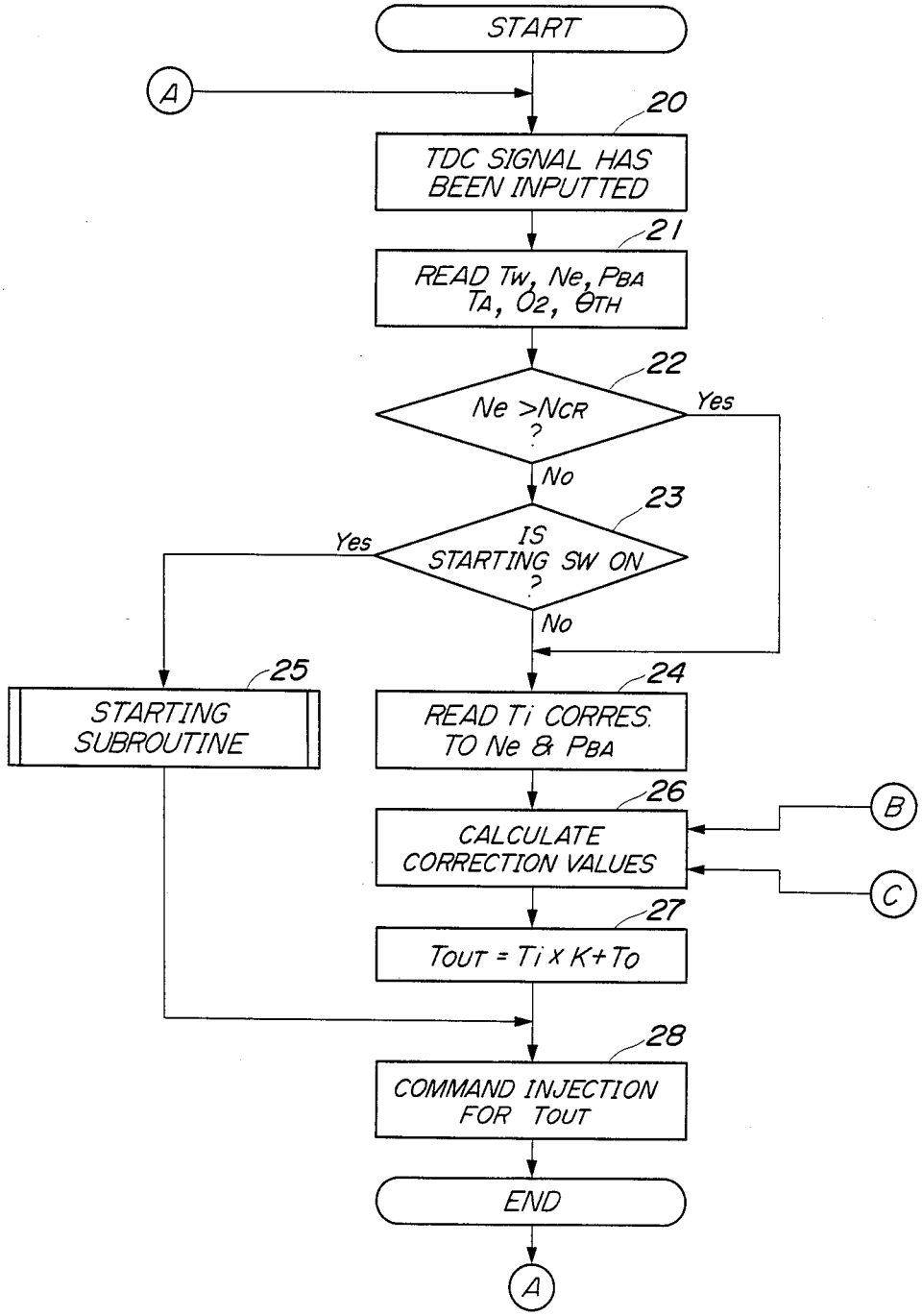
FIG. 2 is a flowchart of a program for executing the fuel supply control by means of an electronic control unit (ECU) appearing in FIG. 1.

The ECU 5 is adapted to execute a fuel supply control program shown in FIG. 2 in synchronism with inputting of each pulse of the TDC signal thereto. Each time a pulse of the TDC signal is inputted to the ECU 5 (step 20), sensed values of the engine coolant temperature TW, the engine rotational speed Ne, the intake pipe absolute pressure PBA, the intake air temperature TA, the oxygen concentration $O_2$, the throttle valve opening $\theta$th, etc., which are inputted to the ECU 5, are read by the CPU **5*b* at a step 21. Then, it is determined at a step 22** whether or not the engine rotational speed Ne has increased above a predetermined cranking value NCR (e.g. 400 rpm). If the answer to the question of the step 22 is negative or No, the program proceeds to a step 23 to determine whether or not the starting switch 16 is on. If the answer is negative or No, that is, if the starting switch 16 is off indicating that the starting motor is not operating, the program proceeds to a step 24, hereinafter referred to. This step 24 is also executed directly when the answer to the question of the step 22 is affirmative or Yes, while the step 23 is skipped. If the answer to the question of the step 23 is affirmative or Yes, that is, if the starting switch 16 is on, a step 25 is called to execute a starting subroutine wherein the valve opening period TOUT of the fuel injection valves 6 to be applied during starting operation of the engine 1 is calculated.

On the other hand, if the starting switch 16 is determined to be off, the step 24 and et seq. are executed to carry out basic control of the valve opening of the fuel injection valves 6 to be applied during normal operation of the engine 1. To be specific, first at the step 24, a basic value Ti of the valve opening period of the fuel injection valves 6 is read out of a table stored within the memory means 5c, which corresponds to the sensed values of the engine rotational speed Ne and the intake pipe absolute pressure PBA read at the step 21. Then, a step 26 is executed to calculate values of various correction coefficients K including an after-start fuel increasing coefficient KAST, an oxygen concentration-dependent correction coefficient $KO_2$, and a coolant temperature-dependent fuel increasing coefficient KTW, as well as values of various correction values To. The values of the correction coefficients K and the correction values To are so calculated in response to values of the various engine operating parameter signals noted hereinbefore as to optimize operating characteristics of the engine 1 such as fuel consumption, driveability, and emission characteristics.

Based upon the calculated values of the correction coefficients and correction values, a calculation of the valve opening period or fuel injection period of the fuel injection valves 6 is executed at a step 27, by the use of the following equation (1):

$$TOUT = Ti \times K + To \quad (1)$$

Then, a step 28 is executed to issue a command signal based upon the valve opening period TOUT calculated as above for the fuel injection valves 6. That is, the ECU 5 supplies a driving signal corresponding to the calculated TOUT value to each of the fuel injection valves 6 through the output circuit means 5d to cause same to open for the time period TOUT.

Figure 3:
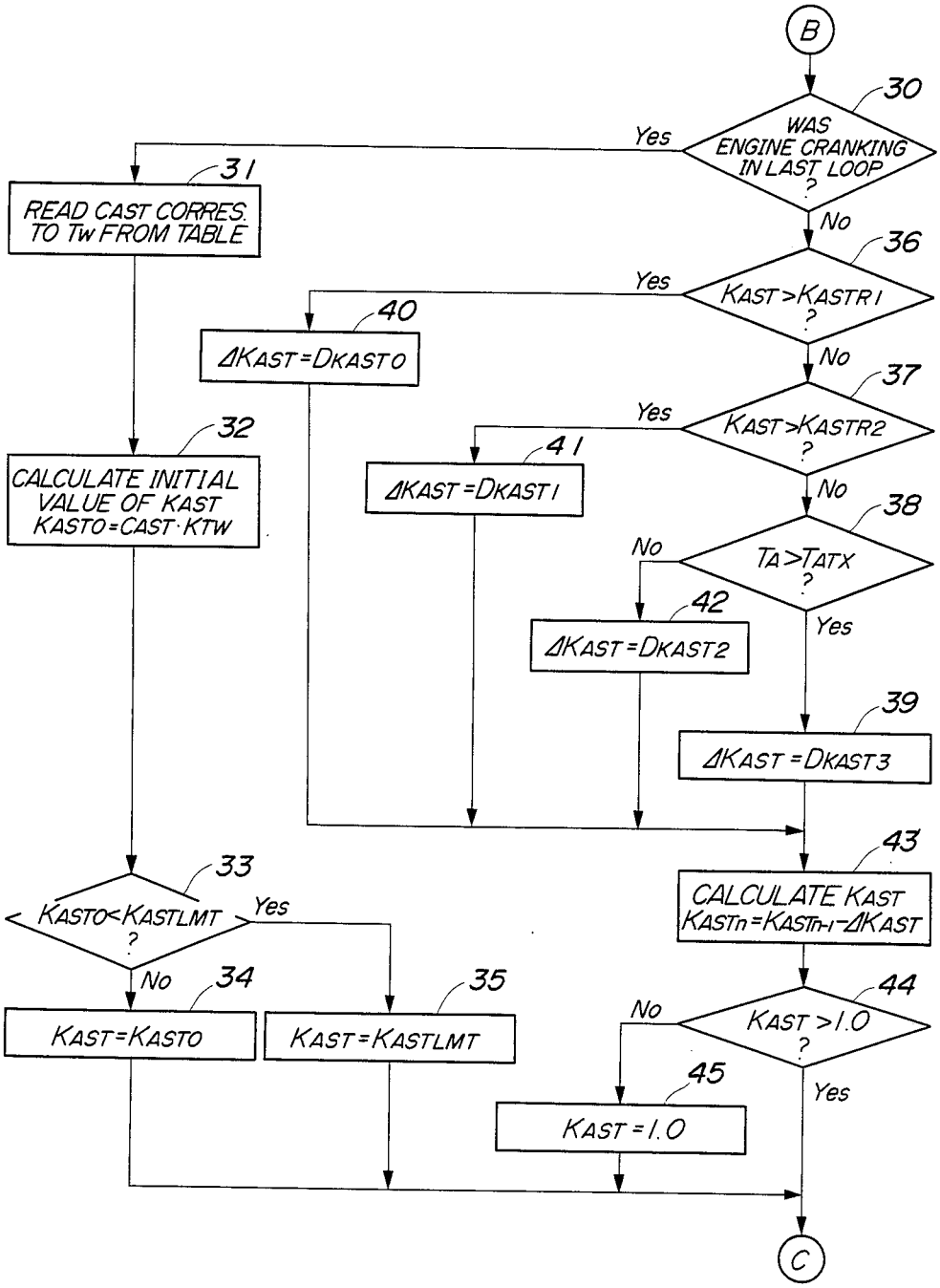
FIG. 3 is a flowchart of a subroutine for calculating an after-start fuel increasing coefficient KAST.

FIG. 3 shows a subroutine for calculating the after-start fuel increasing coefficient KAST.

Figure 5:
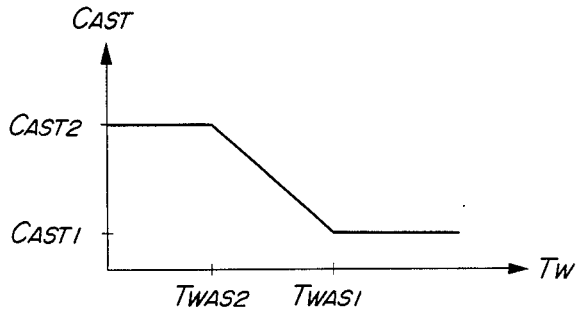
FIG. 5 is a graph showing a table of the relationship between a calibration variable CAST applied to calculation of an initial value KAST0 of the after-start fuel increasing coefficient KAST and engine coolant temperature TW.

First, at a step 30 it is determined whether or not the engine was being cranked in the last loop. If the answer is affirmative or Yes, that is, if the present loop is the first one immediately after completion of the cranking operation of the engine 1, the program proceeds to a step 31 wherein a value CAST is determined from a table shown in FIG. 5 and stored within the memory means 5c, which corresponds to the engine coolant temperature TW. The value CAST is a calibration variable applied for calculating an initial value of the after-start fuel increasing coefficient KAST. In the table for determining this calibration variable CAST, shown in FIG. 5, there are provided two predetermined values TWAS1 (e.g. +18° C.) and TWAS2 (e.g. −10° C.) of the engine coolant temperature TW, whereby a predetermined value CAST2 (e.g. 1.2) is selected if the sensed coolant temperatuer TW is lower than the predetermined value TWAS2, and a predetermined value CAST1 (e.g. 0.9) when the sensed coolant temperature TW is higher than the predetermined value TWAS1, respectively. If the sensed coolant temperature TW falls between the values TWAS1 and TWAS1, a CAST value corresponding to the sensed coolant temperature TW is calculated by means of an interpolation method. The calibration variable table may be set in various forms so as to conform to operating characteristics of engines applied. The engine coolant temperature applied for determining the CAST value is preferably sensed upon generation of a pulse of the TDC signal at the time of completion of the engine cranking operation.

Figure 6:
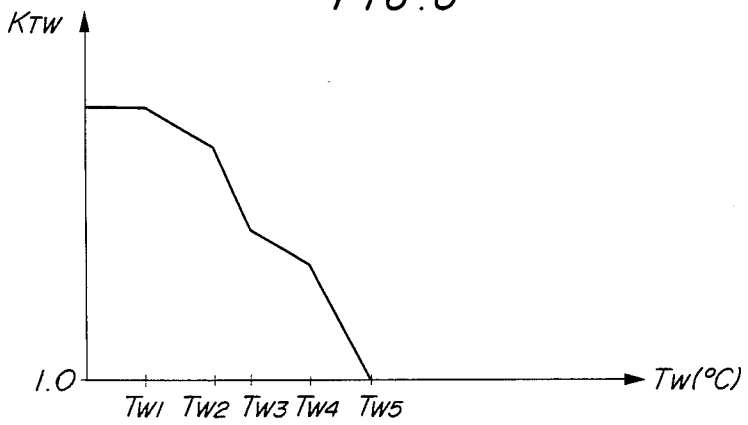
FIG. 6 is a graph showing the relationship between the coolant temperature-dependent fuel increasing coefficient KTW and engine coolant temperature TW.

Referring again to FIG. 3, the program then proceeds to a step 32 wherein the initial value KAST0 of the after-start fuel increasing coefficient KAST is calculated according to the following equation (2) using the CAST value obtained as above:

$$KAST0 = CAST \times KTW \quad (2)$$

where KTW is the coolant temperature-dependent fuel increasing coefficient, referred to hereinbefore, and is determined from a table shown in FIG. 6 in response to the sensed coolant temperature TW. According to the FIG. 6 table, when the sensed coolant temperature TW is equal to or higher than a predetermined value TW5 (e.g. 60° C.), the KTW value is held at 1.0, and when the TW value is lower than the predetermined value TW5, one of a plurality of predetermined KTW values corresponding, respectively, to predetermined values TW1–TW4 is selected from the table. If the sensed coolant temperature TW falls between adjacent ones of the predetermined values TW1–TW5, the KTW value is determined by means of an interpolation method.

After the KTW value has thus been determined, the program then proceeds to a step 33 to determine whether or not the initial value KAST0 determined at the step 32 is smaller than a predetermined lower limit KASTLMT (e.g. 1.2). If the answer is negative or No, the initial value KAST0 determined at the step 32 is directly applied as the coefficient KAST at a step 34, followed by termination of the program. If the answer to the question of the step 33 is affirmative or Yes, the predetermined lower limit KASTLMT is applied as the coefficient KAST, in place of the initial value KAST0 determined at the step 32, followed by termination of the program.

The steps 31 through 35 for setting the after-start fuel increasing coefficient KAST described above are executed only one time immediately after the engine cranking operation has been completed, and thereafter a step 36 and et seq. are repeatedly executed in synchronism with generation of TDC signal pulses, as described below.

Figure 7:
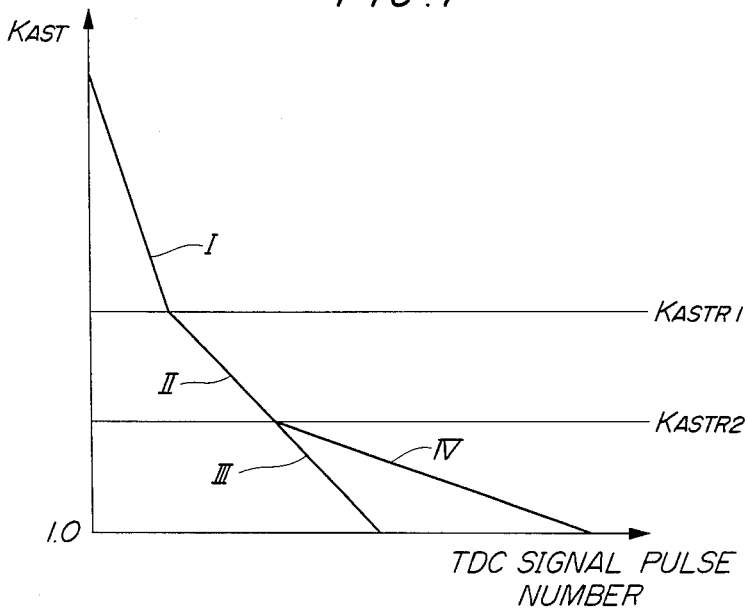
FIG. 7 is a graph showing the relationship between the after-start fuel increasing coefficient KAST and the number of TDC signal pulses generated.

If the answer to the question of the step 30 is negative or No, the program proceeds to the step 36 wherein it is determined whether or not the coefficient KAST is larger than a predetermined first value KASTR1 defining the KAST curve in FIG. 7. If the answer is affirmative or Yes, a decreasing constant ΔKAST is set to a first predetermined value DKAST0 at a step 40, while if the answer is negative or No, a step 37 is executed to determine whether or not the coefficient KAST is larger than a second predetermined value KASTR2 also defining the KAST curve in FIG. 7. If the answer is affirmative or Yes, the decreasing constant ΔKAST is set to a second predetermined value DKAST1 which is smaller than the first predetermined value DKAST0, at a step 41.

If the answer to the question of the step 37 is negative or No, the program proceeds to a step 38 wherein it is determined whether or not the sensed intake air temperature TA is higher than a predetermined value TATX (e.g. 70° C.) above which gas bubbles can be formed in the fuel within the fuel supply system of the engine such as the interior of the fuel injection valves 6. If the answer is negative or No, the program proceeds to a step 42 to set the decreasing constant ΔKAST to a third predetermined value DKAST2 which is equal to the second predetermined value DKAST1. If the answer to the question of the step 38 is affirmative or Yes, the decreasing constant ΔKAST is set to a fourth predetermined value DKAST3 which is almost equal to the second predetermined value DKAST1, that is, which is set at such a value that the resulting fuel increasing time period is sufficient to remove all the gas bubbles from the fuel within the fuel injection valves 6.

Then, at a step 43, the decreasing constant KAST thus determined is deducted from a value of the coefficient KAST applied in the last loop.

In this way, when the coefficient KAST has a value larger than the first predetermined value KASTR1, it is decreased at a higher rate as shown by the line I in FIG. 7; when the coefficient KAST lies between the first and second predetermined values KASTR1 and KASTR2, it is decreased at a smaller rate as shown by the line II in FIG. 7; and when the coefficient KAST is smaller than the second predetermined value KASTR2, it is decreased at different rates depending upon whether the sensed intake air temperature TA is higher than the predetermined value TATX, that is, as shown by the line III in FIG. 7 if TA is higher than TATX, and the line IV if TA is equal to or lower than TATX. Thus, the period of time for which the after-start fuel increasing coefficient KAST is applied after starting of the engine, i.e. immediately after completion of the engine cranking operation is set to a shorter value if the intake air temperature TA representative of the temperature in the intake system of the engine exceeds a value above which gas bubbles can be formed in the engine intake system. The shorter fuel increasing period prevents the mixture supplied to the engine from being overriched, to thereby ensure good driveability of the engine after starting and curtail the fuel consumption.

Following the decrease of the coefficient KAST by KAST at the step 43, it is determined at a step 44 whether or not the coefficient KAST thus decreased is larger than 1.0. If the answer is affirmative or Yes, the program is immediately terminated, while if the answer is negative or No, the coefficient KAST is set to 1.0, followed by termination of the program.

Thereafter, the decrease of the coefficient KAST at the step 43 is repeatedly carried out each time a TDC signal pulse is generated, whereby the coefficient KAST is decreased along a bent line I-II-II or I-II-IV shown in FIG. 7.

Figure 4:
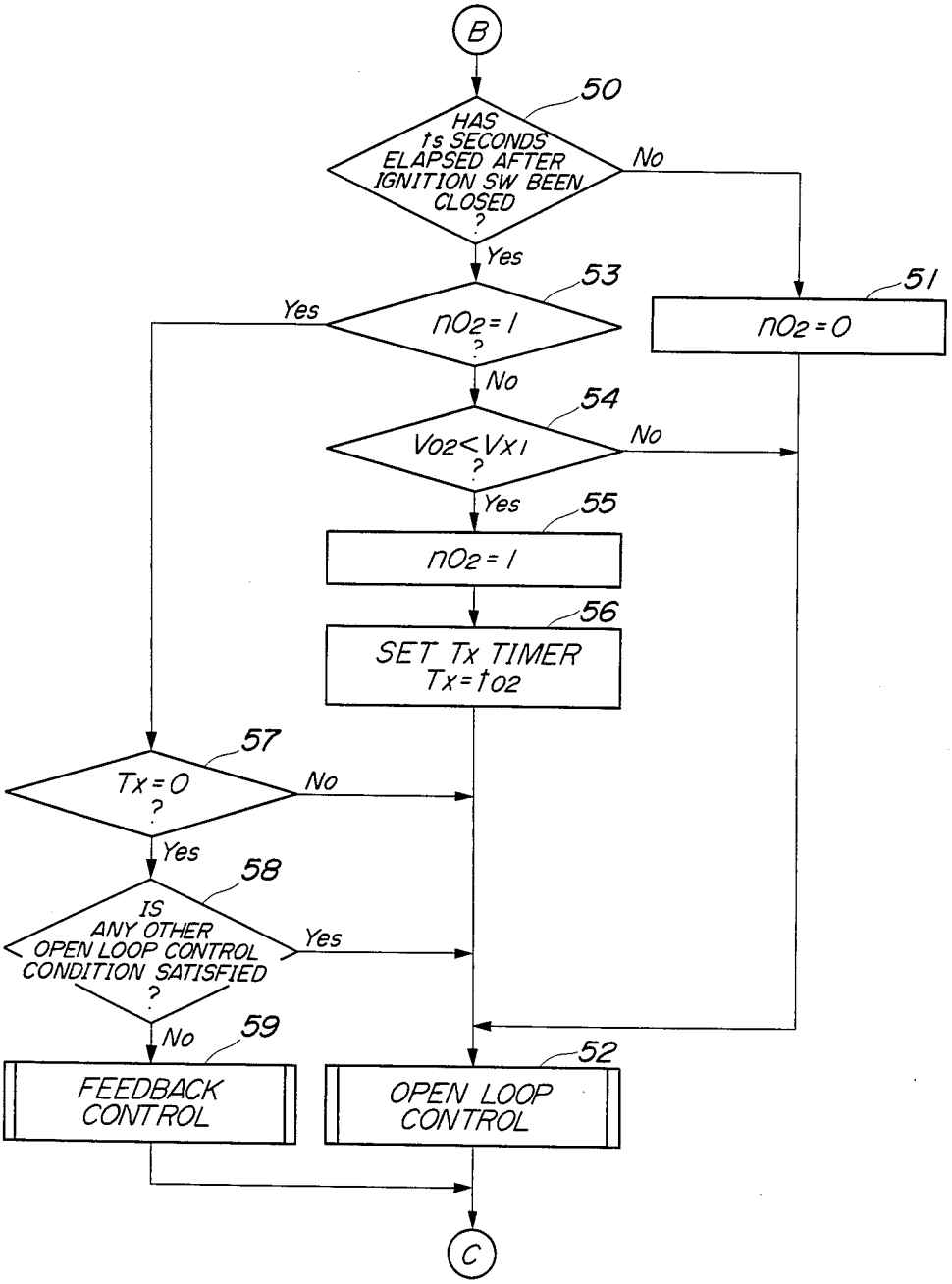
FIG. 4 is a flowchart of a subroutine for determining whether to start the air-fuel ratio feedback control based upon the output of an oxygen concentration sensor ($O_2$ sensor) appearing in FIG. 1.

FIG. 4 shows a manner of determining whether to start the air-fuel ratio feedback control based upon the oxygen concentration-dependent correction coefficient $KO_2$ as one of the correction values calculated at the step 26 in FIG. 2. First at a step 50, a determination is made as to whether or not a predetermined period of time (ts seconds), within which it becomes possible to effect determination of the activation of the oxygen concentration sensor 15, has elapsed after an ignition switch, not shown, of the engine was turned on. If the answer is negative or No, the program proceeds to a step 51 wherein a flag $nO_2$ is reset to 0 to indicate that it is not yet possible to effect determination of the activation of the oxygen concentration sensor 15. Then, a step 52 is executed wherein air fuel ratio open loop control is carried out, e.g. by applying the after-start fuel increasing coefficient KAST for increasing the fuel quantity supplied to the engine while the value of the oxygen concentration-dependent correcion coefficient $KO_2$ is held at 1.0.

Figure 8:
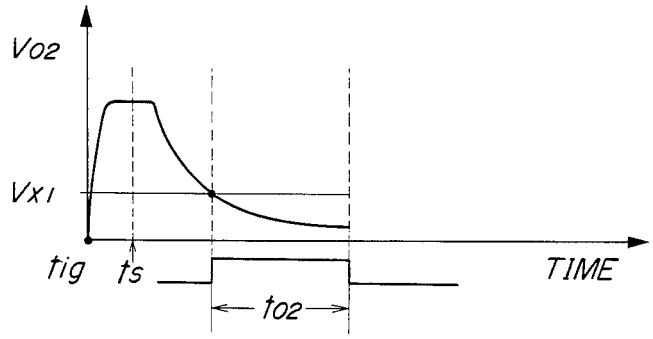
FIG. 8 is a graph showing a change in the output voltage of the oxygen concentration sensor with respect to time.

FIG. 8 shows a change in the output voltage $VO_2$ from the oxygen concentration sensor 15 plotted with respect to time. Since the output voltage $VO_2$ of the sensor 15 is formed by the internal resistance of the sensor 15 to which is applied constant current via a fixed resistance from a constant voltage-regulated power supply, a great electromotive force is generated by the sensor 15 immediately after the ignition switch is closed at a time point tig in FIG. 8 so that the output voltage $VO_2$ sharply rises and reaches the maximum value before the following predetermined period of time (ts seconds) elapses. Thereafter, the output voltage $VO_2$ gradually lowers as the internal resistance of the sensor 15 decreases with an increase in the sensor temperature. This decrease of the output voltage $VO_2$ is continued even after it drops below a predetermined value VXl which is a threshold value below which it can be estimated that the sensor 15 has become activated. As described hereinafter, when the output voltage $VO_2$ reaches the predetermined value VXl, a TX timer formed of a downcounter has its initial count value TX set to a value $tO_2$ corresponding to a predetermined period of time, and upon the lapse of this predetermined period of time ($=tO_2$) at which the count value is zero, it is judged that the activation of the sensor 15 has been completed, whereupon the control mode is switched from open loop control including fuel increasing control based upon the after-start fuel increasing coefficient KAST to feedback control based upon the oxygen concentration-dependent correction coefficient $KO_2$, as stated hereinafter.

Figure 9:
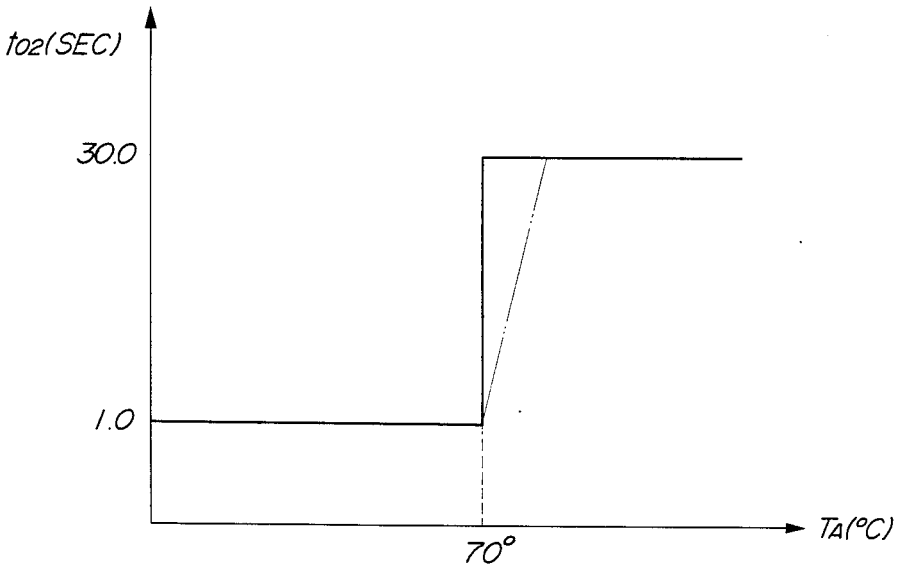
FIG. 9 is a graph showing a table of the relationship between a time period elapsed from the time of completion of activation of the oxygen concentration sensor and engine intake air temperature TA.

On the other hand, if the answer to the question of the step 50 is affirmative or Yes, that is, if the predetermined time period ts has elapsed, the program proceeds to a step 53 wherein it is determined whether or not the flag $nO_2$ is 1 indicating the possibility of determining the activation of the oxygen concentration sensor 15. If the answer is negative or No, the program proceeds to a step 54 to determine whether or not the output voltage $VO_2$ has dropped below the predetermined value VXl. If the answer is negative or No, the aforedescribed open loop control is continually executed at the step 52, while if the answer is affirmative or Yes, a step 55 is executed to set the flag $nO_2$ to 1, followed by setting the count of the TX timer to $tO_2$ and simultaneously starting the same timer for counting the predetermined time period corresponding to $tO_2$ from the time the output voltage $VO_2$ has dropped below the predetermined value VXl. The value $tO_2$ to be counted by the TX timer is read from a table set based upon the intake air temperature TA. This table is shown in FIG. 9 by way of example, according to which the value $tO_2$ is set to 1.0 second when the intake air temperature TA is lower than a predetermined value TATX, e.g. 70° C., and to 30 seconds when TA is above the same predetermined value. The value $tO_2$ may be varied with a change in the intake air temperature TA when TA is higher than the predetermined value (70° C.), as indicated by the chain line in FIG. 9.

On the other hand, if the answer to the question of the step 53 is affirmative or Yes, that is, if the predetermined time period (ts seconds) has elapsed after the turning-on of the ignition switch and also it is judged that the determination of activation of the oxygen concentration sensor 15 can be effected, the program jumps to a step 57 to determine whether or not the TX timer has counted down the set value $tO_2$ (TX=0). If the answer is negative or No, the step 52 is executed to continue execution of the open loop control, while if the answer is affirmative or yes, the program proceeds to a step 58 to determine whether any other condition for executing the open loop control is satisfied, e.g. whether the engine is in any of a cold condition, a predetermined low rotational speed region, a predetermined high rotational speed region, a wide-open-throttle region, a mixture-leaning region, and a fuel cut-effecting region. If the engine is determined in any of these condition and regions, the open loop control is continually executed at the step 52, while if the engine is not, the program proceeds to a step 59 to start execution of the feedback control wherein the oxygen concentration-dependent correction coefficient $KO_2$ is varied in response to the output voltage $VO_2$ from the oxygen concentration sensor 15.

What is claimed is:

1. In a method of controlling the supply of fuel to an internal combustion engine after starting thereof, including the steps of increasing a quantity of fuel to be supplied to said engine by the use of a fuel increment after the starting of the engine, counting a period of time which elapses from the time a sensor for sensing oxygen concentration in exhaust gases from said engine has internal resistance thereof decreased below a predetermined value after the starting of said engine, terminating said increase of said quantity of fuel to be supplied to said engine and simultaneously starting calculating a value of a correction value in response to the oxygen concentration sensed by said sensor when said period of time counted exceeds a predetermined period of time, and correcting said quantity of fuel to be supplied to said engine by means of said correction value calculated, the improvement comprising the steps of: (a) sensing a temperature in an intake system of said engine; and (b) increasing said predetermined period of time as said temperature in said intake system sensed is higher.

2. A method as claimed in claim 1, wherein when said temperature in said intake system sensed is lower than a predetermined value, said predetermined period of time is set to a first value, and when said temperature in said intake system sensed is higher than said predetermined value, said predetermined period of time is set to a second value larger than said first value.

3. A method as claimed in claim 1, wherein when said temperature in said intake system sensed is higher than said predetermined value, said predetermined period of time is set to larger values as said temperature sensed in said intake system becomes higher.

4. A method as claimed in claim 1, wherein said temperature in said intake system is the temperature of intake air being supplied to said engine.

5. A method as claimed in claim 1, wherein said fuel increment is gradually decreased with the lapse of time, the rate of said gradual decrease of said fuel increment being increased as said temperature in said intake system is higher.

6. A method as climed in claim 5, wherein said fuel increment is deducted by a predetermined decreasing constant, said constant being set to a larger value as said temperature in said intake system is higher.

* * * * *